United States Patent [19]

Mills et al.

[11] Patent Number: 4,505,332

[45] Date of Patent: Mar. 19, 1985

[54] WELL PACKERS

[75] Inventors: Aubrey C. Mills; Neil H. Akkerman, both of Houston, Tex.

[73] Assignee: AVA International Corporation, Houston, Tex.

[21] Appl. No.: 435,675

[22] Filed: Oct. 21, 1982

[51] Int. Cl.[3] ..... E21B 23/00

[52] U.S. Cl. ..... 166/120; 166/134; 166/387

[58] Field of Search ..... 166/120–122, 166/134, 52, 212, 382, 387

[56] References Cited

U.S. PATENT DOCUMENTS

| | | | |
|---|---|---|---|
| 3,098,524 | 7/1963 | Brown | 166/120 |
| 3,211,226 | 10/1965 | Myers et al. | 166/120 |
| 3,299,959 | 1/1967 | Brown | 166/13 X |
| 3,414,058 | 12/1968 | De Rochemont | 166/120 |
| 3,658,127 | 4/1972 | Crochran et al. | 166/120 |
| 4,311,195 | 1/1982 | Mullins | 166/120 |

OTHER PUBLICATIONS

Composite Catalog of Oil Field Equipment and Services, p. 865, 1982–1983.

*Primary Examiner*—Stephen J. Novosad

*Assistant Examiner*—Thuy M. Bui

*Attorney, Agent, or Firm*—Vaden, Eickenroht, Thompson, Bednar & Jamison

[57] ABSTRACT

There is disclosed a dual well string, hydraulically operated, retrievable packer in which one mandrel connectible with one well string is releasably connected to the body means of the packer to permit it to be lowered therewith, and the other mandrel connectible to the other well string is vertically reciprocable with respect to the body means and thus with respect to the first-mentioned mandrel. The packing element and slip assembly of the packer are supported on and carried about a first body section, and a second body section includes an expander plate which is movable relative to the first body section to expand the packing element and the slip assembly into engagement with the well bore by means of a hydraulically actuated mechanism including pistons reciprocable within cylinders formed in the first body section and connected to the expander plate by means of a pair of rods. One such rod has a through bore which permits circulation between a tubular member connected to its upper end and the annulus within the well bore beneath the packer, and the other rod has a bore which is open at its lower end to permit the supply and exhaust of hydraulic fluid to and from the cylinders.

26 Claims, 23 Drawing Figures

WELL PACKERS

This invention relates generally to well packers, and, more particularly, to improvements in hydraulically set, retrievable well packers. In one of its important aspects, it relates to improvements in dual or other multiple string packers of this type.

In a typical dual well string installation, a packer is lowered into and set within the well bore to close off the space about both strings above an upper production zone, and another packer beneath the dual packer and the lower end of one of the strings (known as the "short string") is lowered with the other string (known as the "long string") to seal thereabout below the upper zone but above the lower production zone. Thus, oil or gas from the upper zone is produced through the short string, and oil or gas from the lower zone is produced through the long string.

As shown, for example, in U.S. Pat. No. 3,414,058, as well as on page 865 of the 1982–83 *Composite Catalog of Oilfield Equipment and Services,* dual string packers of this type normally comprise body means on which a packing element is supported and about which a slip assembly is carried, together with a pair of mandrels extending vertically within the body means and through side-by-side holes in the packing element so that each may be connected as a part of one of the well strings. Ordinarily, one of the mandrels is adapted to be temporarily closed so that, with the packer lowered to the desired position, hydraulic fluid may be supplied through the one mandrel to means on the body means for causing relative vertical movement between sections of the body means above and below the packing element and slip assembly in order to move them into engagement with the well bore. The body sections are locked in this position within the well bore until it is desired to retrieve the packer, at which time the hydraulic fluid is exhausted, and the well strings manipulated in order to release the locking means to permit the slip assembly and packing element to be retracted as the packer is raised from the well bore with the well strings.

As also shown in the aforementioned patent and publication, conventionally, the body means includes a so-called receiver or receptacle having openings at its upper end forming upper continuations of the mandrels. The lower end of the upper portion of one of the strings is connected to one of the receiver openings to permit the lower portions of both strings to be lowered with the packer into the well bore. Then, when the packer has been set, the lower end of the upper portion of the other string may be lowered into and connected with the other opening in the receiver.

Since the upper portions of both strings must be individually lowered into place, packers of the above-described construction are not only expensive to manufacture, but also time-consuming to install. Also, as shown and described, for example, in copending application, Ser. No. 233,628, filed by Neil H. Akkerman on Feb. 17, 1981, and entitled "Flow Controlling Apparatus", packers are often used as part of a system for controlling circulation between the annulus in the well bore above and below the packer. In such a system, the packer is located high in the well so that, in the case of a dual installation, the load to be carried by the one string on which the packer is lowered is substantially higher than it would be if the packer was instead installed in its customary deep location.

There are other well installations in which there is a need for lowering a plurality of dual packers of this type into the well bore, as, for example, when two or more vertically spaced production zones are to be produced through the same string. In such an installation, only the uppermost packer requires a receiver. Furthermore, there may be need for vertically manipulating at least one of the strings, and/or rotationally manipulating each string independently of the other and the body means, during as well as after installation. It would therefore be desirable and is an object of this invention to provide such a dual packer which does not require a receiver and in which each string may carry its own weight and be manipulatable independently of the other string, as the packer is lowered into place, without the risk of damaging either string or the packer itself.

As shown on page 955 of the aforementioned publication, in prior dual packers used in annulus safety systems of the type above described, circulation to or from the annulus below the packer has comprised an annular passageway within the body means about one of the mandrels. Due to the limited space occupied by the side-by-side mandrels, this has required the inner diameter of the mandrel about which the passageway is formed be reduced, thereby limiting its flow capacity. It is a further object of this invention to provide a dual packer of the type described in which the desired circulation may be accomplished without reducing the flow capacity of either mandrel, and, more particularly, through a passageway which is also useful in activating the hydraulic mechanism in setting the packer.

In prior dual packers of this type, the packer has been supported against vertical movement in the well bore in one of two ways. Thus, As shown in U.S. Pat. No. 3,414,058 as well as page 865 of the aforementioned publication the packer may be prevented from moving vertically in one direction by slip teeth on so-called "buttons" having inner piston surfaces adapted to be urged outwardly to grip the well bore by hydraulic pressure supplied thereto through one of the mandrels. Another set of slips for preventing vertical movement of the packer in the opposite direction are carried about expander surfaces on the body means below the packing element. Packers of this type are, however, of relatively complicated construction, which is particularly undesirable when a passageway is to be formed through the packer in the case of an annulus safety system. Also, since the buttons are above the packing element, sand and other debris above the packing element may accumulate to the extent making it difficult to retract them and thus retrieve the packer.

Alternatively, and as shown in U.S. Pat. No. 3,658,127 both sets of slips may be carried by expander surfaces on the body means below the packing element, with the expander surfaces being formed on body sections adapted to be moved vertically toward or away from one another in order to move the slips into or out of gripping engagement with the well bore. This not only simplifies the construction of the packer, and thus lowers its expenses, but also protects the slips from debris above the packing element. However, in prior packers of this latter type, the packer is locked in its set position by a locking means, such as a body lock ring, engageable with opposing annular surfaces on the body means and one of the mandrels. In order to carry the considerable tension thus applied to it, the mandrel has been thicker than it would otherwise be and has thus required that it be substantially restricted. Also, this arrangement prevents movement of the strings with respect to one another when the packer is set.

It is therefore an object of this invention to provide a packer in which both sets of slips are disposed beneath the packing element, but in which they may be expanded by means which does not require that tension be applied to either mandrel in order to hold the packer in set position.

A still further object of this invention is to provide a packer which accomplishes the foregoing object by means which is also useful in providing the above-described passageway through the packer, or in supplying fluid to fluid-actuated means for setting the packer, or both.

Since the mandrel and other parts of a single string packer of this type are conventionally arranged concentrically of one anther, the means including the aforementioned body lock ring for locking them in set position, for releasing the locking means when the packer is to be unset and retrieved, and in holding the parts against premature setting as the packer is lowered into the bore, may be of relatively simple construction. The non-concentric arrangement of the mandrels of a dual packer would ordinarily inherently complicate its construction. It is therefore another object of the present invention is to provide such a dual well packer of this type wherein such parts are of relatively simple and inexpensive construction.

As shown in U.S. Pat. No. 4,311,195, it is also conventional practice, in a packer of this type, whether a dual or single, to hold the vertically movable parts of the packer against premature movement, in order to set the packer, by a releasable latch of some type. Frequently, this latch is retained in latching position by a piston adapted to be moved out of retaining position in response to the same fluid source which causes relative movement between the parts of the packer. As the packer is installed, however, the retainer is held in position by a pin or other part which is sheared by a force due to the supply of fluid thereto. Thus, enough force must be applied to the retainer to not only move it to latch releasing position, but also to first shear the pin which holds it in place. It is therefore yet another object of this invention to provide a packer of this general type in which the force required to shear the pin is separate from that required to release the latch whereby the force to release the latch and hold it released is only the greater of the two rather than their sum.

Another object of this invention is to provide such a packer which may be released prior to retrieval in a relatively simple manner, and, more particularly, in which the slip expander surfaces may be moved relative to the slips in order to retract them without the necessity of overcoming frictional resistance due to dynamic seal surfaces, and further in which atmospheric chambers useful in setting the packer are also useful in releasing it.

These and other objects are accomplished, in accordance with the illustrated embodiment of the present invention, by a dual string packer of the type above described, wherein the body means on which the packing element is supported and on which the slip assembly is carried is in turn supported from one of the mandrels to permit it to be lowered with one string into the well bore, and, when the packer has been lowered into a desired position within the well bore, to permit the slip assembly to be moved into gripping engagement with the well bore and the packing element to be moved into sealing engagement with the well bore by fluid-actuated means within the body means. More particularly, the other mandrel is movable vertically with respect to the body means, whereby the weight of the lower portion of each well string is carried by its mandrel, and the strings may be moved vertically relative to one another, and thus handled by individual elevators at the wellhead during lowering of the packer into the well bore, without damage to either string as they are being lowered. Preferably, each mandrel is also rotatable with respect to the body means and with respect to one another, and the other mandrel is free to move vertically with and to rotate respect to the body means not only as the packer is lowered into the well bore, but also when the slip assembly and packing element have been moved into engagement with the well bore.

In the illustrated embodiment of the invention, the body means includes first and second body sections which are vertically reciprocable with respect to one another, with the packing element supported by and the slip assembly carried about the first body section. More particularly, cylinder means is formed in one of the body sections, and the other body section has means including piston means vertically reciprocable within the cylinder means for causing the body sections to move toward one another in order to expand the packing element and slip assembly in response to the supply of fluid pressure to the cylinder means.

In accordance with another novel aspect of the present invention, a tube having an open upper end adapted to be connected to a tubular member extends closely through a hole in the packing element intermediate the holes through which the mandrels extend, and is open at its lower end to permit circulation between the annulus below the packer and the tubular member to which the one tube is connected. As will be described, the tubular member may connect with suitable annulus safety control means above the packer in order to provide control over circulation through the tube.

Preferably, there is a second tube which extends through another hole in the packing element generally diametrically opposed to the first-mentioned tube, and connects at its lower end with the fluid-actuated means in the body means to permit the supply of fluid thereto through another tubular member to which the other tube is connected. In accordance with a still further aspect of the invention, the aforesaid cylinders are formed in the first body section, and each of the tubes is connected to an expander plate of the second body section on a side of the packing element and slip assembly opposite the first body section and has a piston thereon which is reciprocable within a cylinder, whereby fluid pressure supplied to each of the cylinders causes the expander plate to move relatively to the first body section in order to expand the packing element and slip assembly into engagement with the well bore.

Thus, in the preferred and illustrated embodiment of the invention, the tubes serve not only to provide a passageway through the packer which does not require restriction of the flow passage through either of the mandrels, as well as to supply hydraulic fluid to the setting mechanism of the packer, but also transmit the force necessary to expand the packing element and slip assembly without transmitting excessive force through either of the mandrels. Consequently, the mandrels need not be of added thickness to withstand those forces, and are free to be moved relatively with respect to the body means, as previously described.

Furthermore, the packing element may be supported by the first body section above two sets of slips carried upon expander surfaces about the body section for resisting both upward and downward movement of the packer when in gripping engagement with the well bore. In this case, of course, the expander plate to which the tubular rods are connected is disposed above the packing element so as to expand it between its bottom side and the upper side of the first body section. As previously described, in addition to avoiding the need for expensive button-type slips, this also protects the slips from debris and the like which might accumulate above the packing element.

As also disclosed and described in the illustrated embodiment of this invention, the expander plate is locked in expanding position by locking means which includes a body lock ring disposed between a fitting connected to both rods and coaxially arranged with respect to the first body section. More particularly, the expanding plate can be so held with only a single lock ring, regardless of whether the packer includes two or more mandrels, or, for that matter, whether or not it includes two or more tubes, as described.

In accordance with a still further novel aspect of the present invention, the upper and lower ends of each rod intermediate the expander plate and fitting thereon are connected by means which is releasable upon the exhaustion of fluid from the cylinders and lifting of the mandrels in order to retrieve the packer from the well bore. In this manner, the portion of the first body section in which the cylinders are formed, and which is locked to the fitting, is free to move to a position in which all dynamic seal surfaces including those between it and the mandrels are caused to separate. Thus, the expander surfaces may be moved to positions to retract the slip assembly without having to overcome frictional resistance due to the seals. Additionally, the fitting connected to the rods is so positioned that, upon separation of the ends of the rods and exhaustion of the supply of hydraulic fluid, it will be urged by atmospheric chambers on one side of the pistons toward engagement with that portion of the first housing section in which the cylinders are formed so as to jar such portion in a direction for freeing the seals.

As previously described, and in accordance with still another novel aspect of the present invention, all relatively movable parts of the packer are held in positions to maintain both the packing element and the slip assembly retracted as the packer is lowered into the well bore. Thus, with the second body section connected to one of the mandrels for lowering therewith, and the first and second sets of slips carried respectively about first and second expander parts of the first body section which are vertically reciprocable with one another, the first such part is supported from the second body section in order to maintain the slips and the packing element retracted until the second body section is released from the one mandrel to which it is connected. More particularly, means are provided for releasing the connecting means in response to the supply of hydraulic fluid to the cylinders, and for preventing upward movement of the second part of the second body section upon release of such connecting means, whereby, upon release of the connecting means, the second part of the second body section supported from the one mandrel, and the expander plate is releasably locked in expanding position, as previously described. More particularly, the means for supporting the second part of the second body section from the one mandrel is releasable to permit such one mandrel to be lifted, and such one mandrel has means thereon for lifting the second body section with it in order to lift the expander plate to permit the packing element and slip assembly to retract.

In accordance with a still further aspect of the invention, the second body section is connected to one of the mandrels to hold the expander plate thereof in non-expanding position by means which is releasably in response to the supply of fluid to the cylinders. Additionally, a means is provided for holding the first body section against vertical movement with respect to one mandrel so that, upon release of the connection, the expander plate is moved with the rods relatively to the first body section in order to expand the packing element and slip assembly. Consequently, all that is required is a single releasable connection with one of the mandrels, regardless of how many mandrels are disposed within the packer.

The latching means for releasably holding the body sections in non-expanding position includes latching means which is movable between positions connecting the second section and thus the expanding plate to one of the mandrels and releasing such plate for relative vertical movement with respect to such one mandrel. Additionally, the body means includes fluid-actuated means having a housing formed in the first body section and a piston reciprocable within the additional cylinder, but initially held in a position spaced from the latching means by means which is shearable upon the supply of fluid to the additional cylinder. Thus, a relatively small force is required to first release the piston and move into engagement with the latching means and another relatively small force is then required to move the latching means to releasing position, whereby the plate is free to move relatively with respect to the first body section in order to expand the packing element and slip assembly. In the preferred and illustrated embodiment of the invention, the latching means comprises a split ring disposable with opposed grooves in the second body section and mandrel, and a retainer movable by the additional piston from a position retaining the ring within said grooves to another position releasing it for movement out of one groove.

The aforementioned seals between the first body section and portions of the mandrels extending therethrough define passageways connecting with a port in the lower end of one of the tubular rods to permit hydraulic fluid to be supplied to or exhausted from both cylinders, as well as the latch releasing cylinder. Still further, fluid may also be supplied or exhausted through the passageway alternatively through a port in one of the mandrels and the well string to which it's connected, or through a port in the other tubular rod, which ordinarily provides a passageway between the tubular member connecting with annulus below the packer and annulus safety equipment thereabove.

In the drawings, wherein like reference characters are used throughout to designate like parts:

Figure 1A:
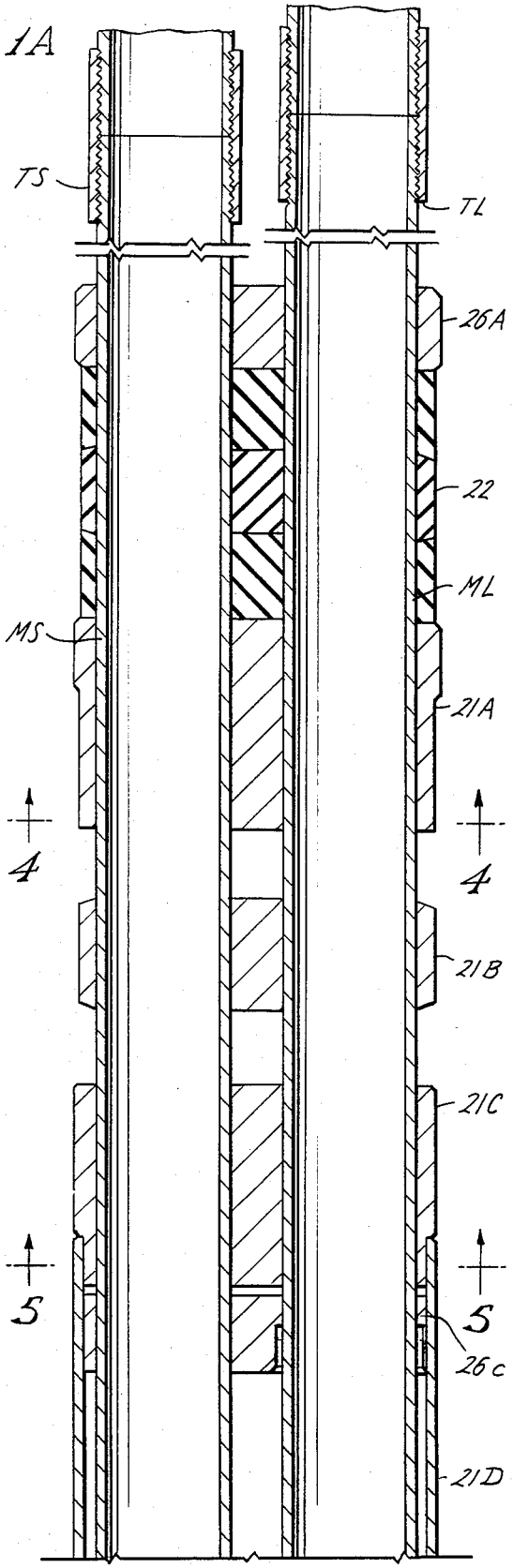
FIGS. 1A, 1B and 1C are vertical sectional views of the upper, intermediate and lower portions of a dual string packer constructed in accordance with the present invention, as seen along broken lines 1—1 of FIG. 6, and with the packing element and slip assembly thereof held in retracted positions during lowering into a well bore.
Figure 4:
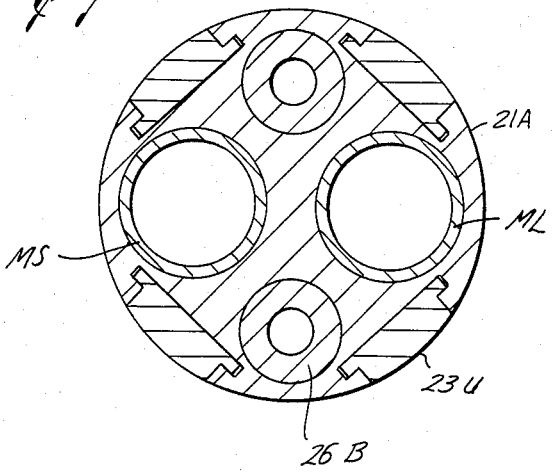
Figure 5:
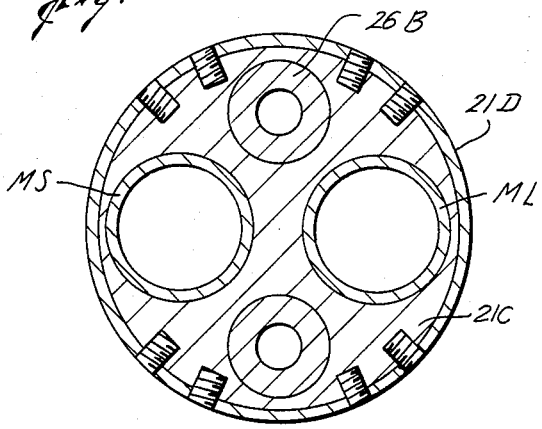
Figure 8:
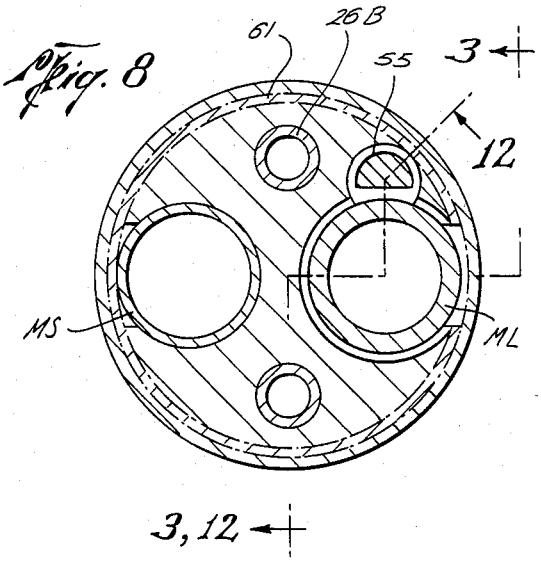
Figure 1B:
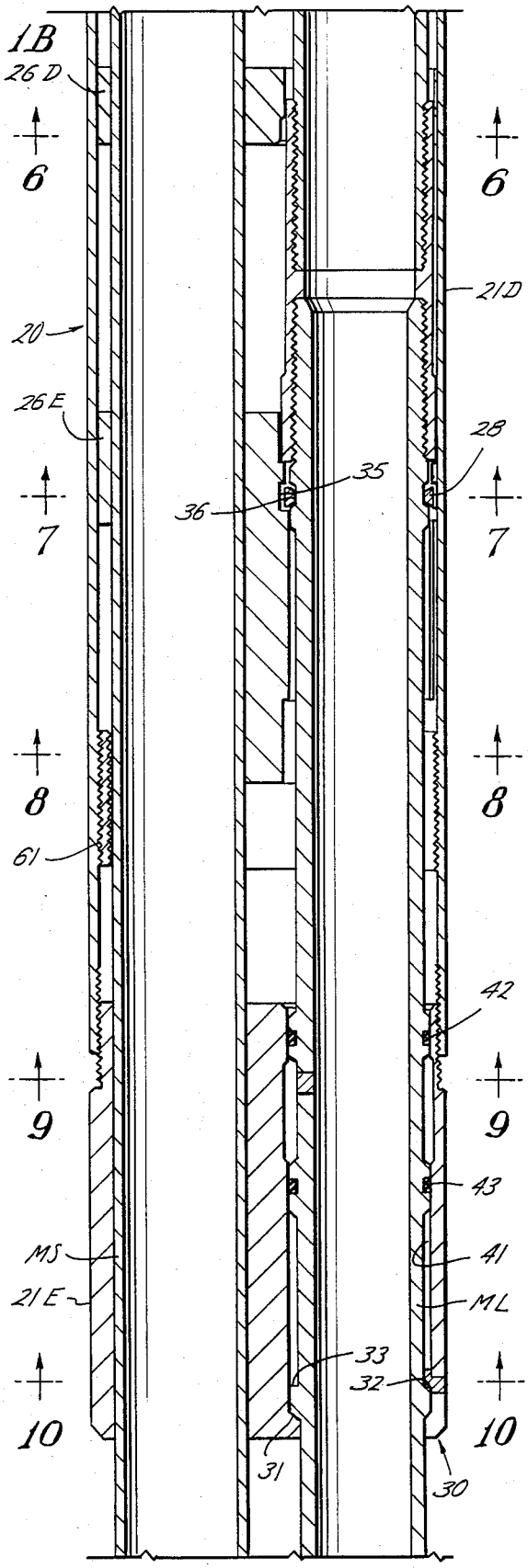
Figure 10:
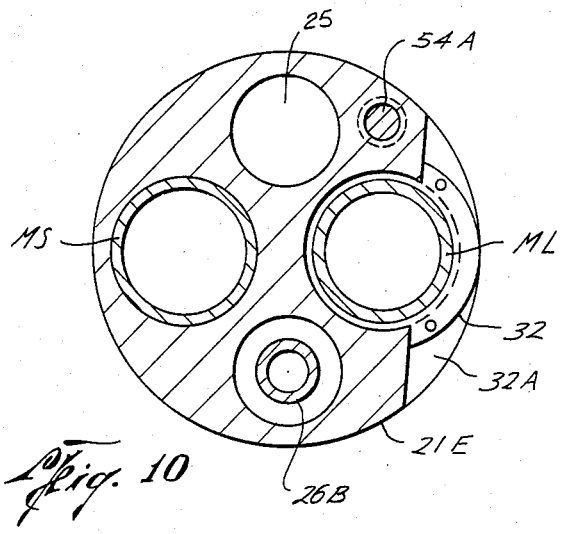
Figure 1C:
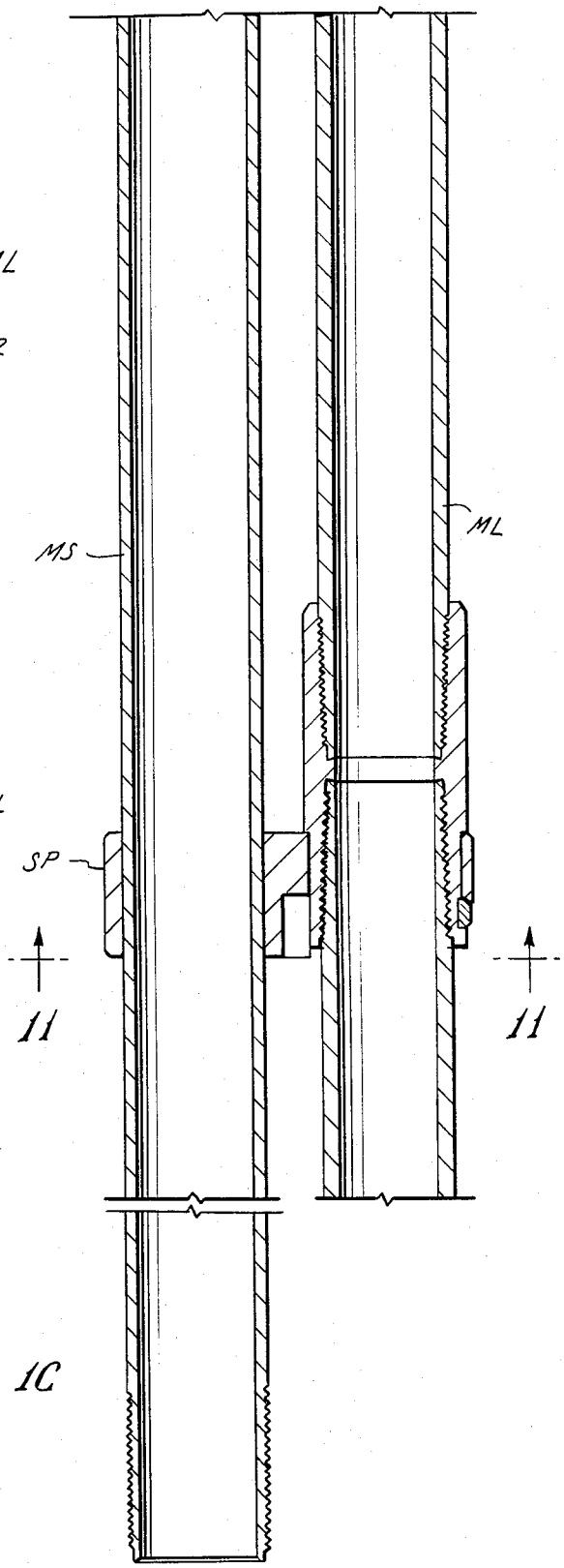
Figure 12A:
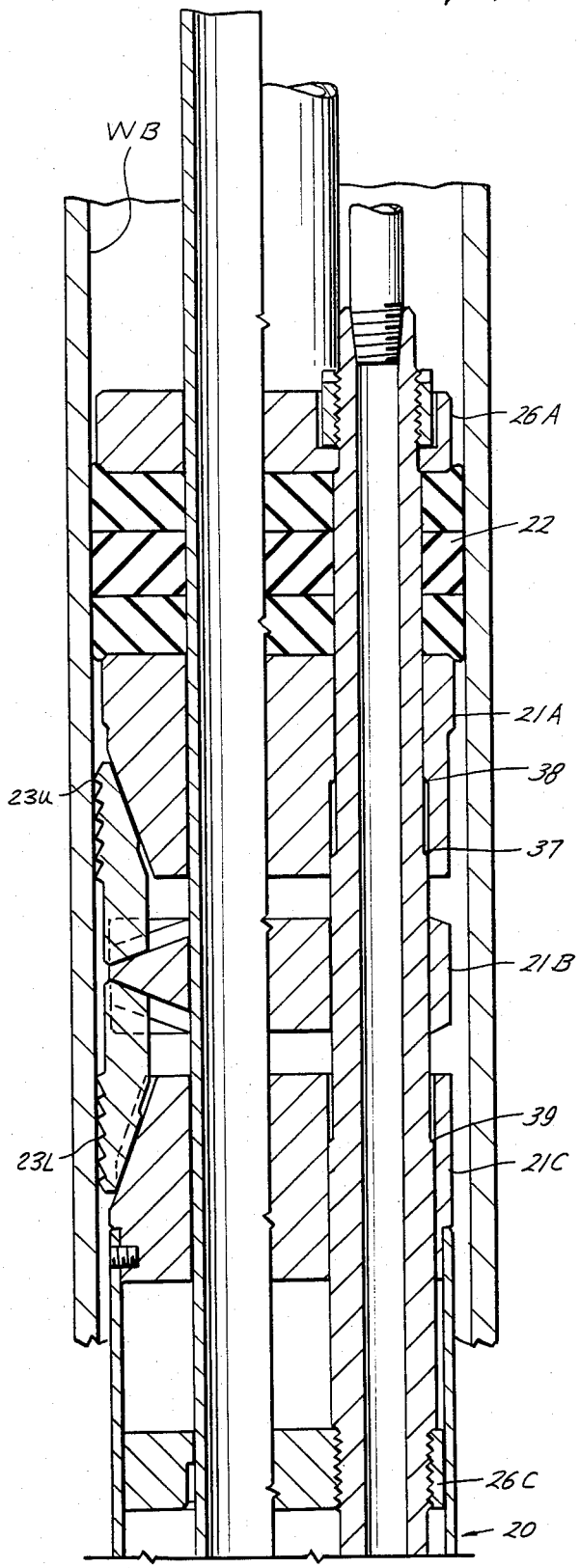
Figure 12B:
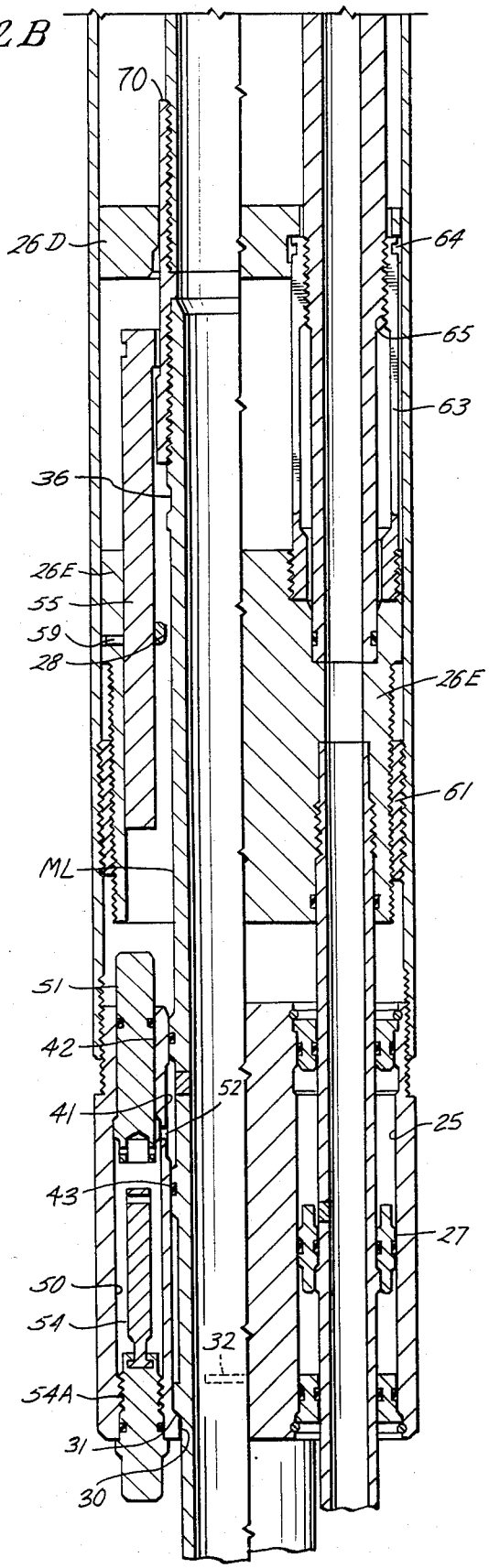
Figure 13A:
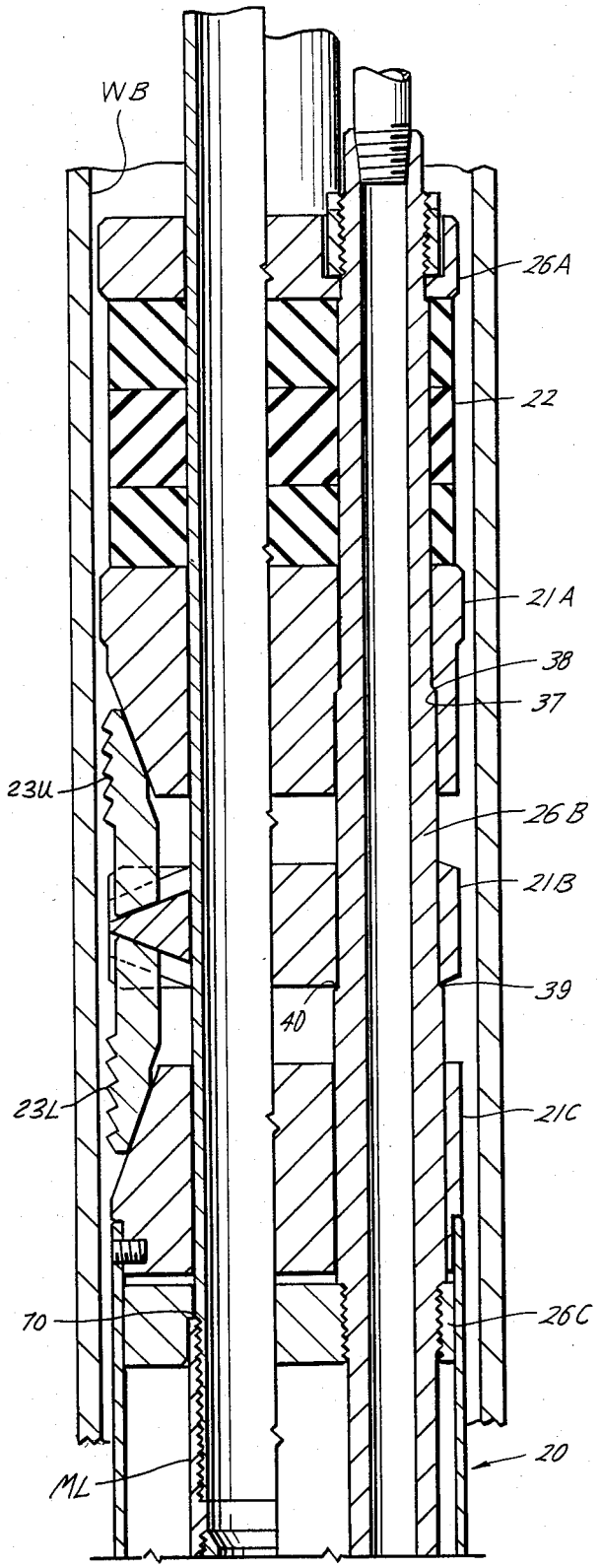
Figure 13B:
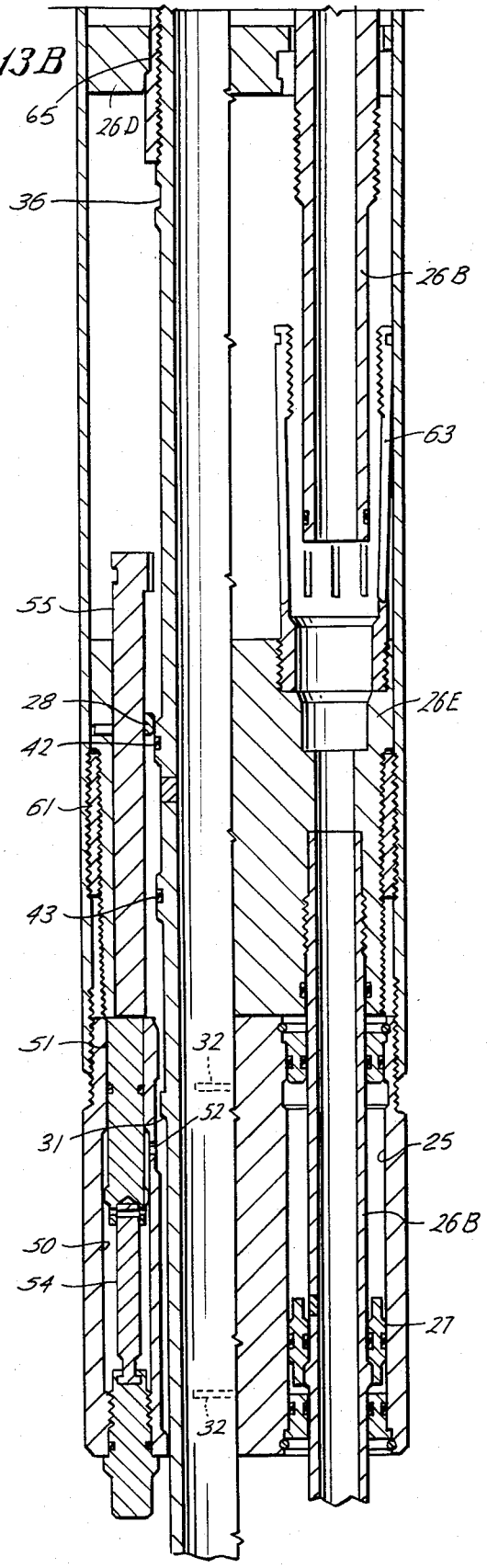
Figure 14:
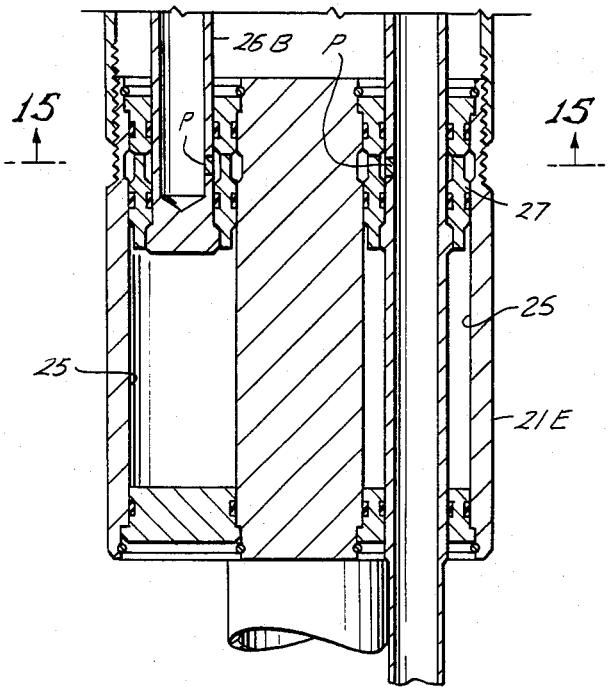
Figure 15:
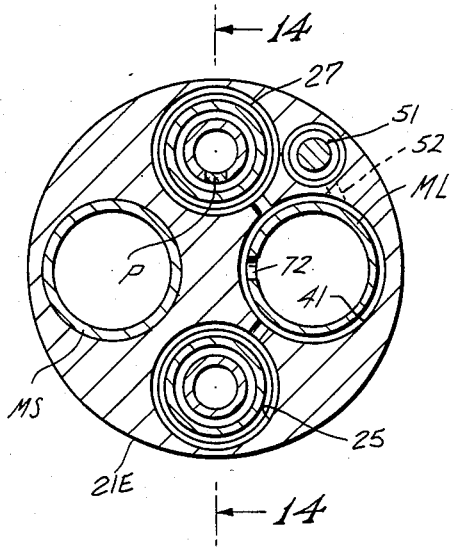
Figure 16:
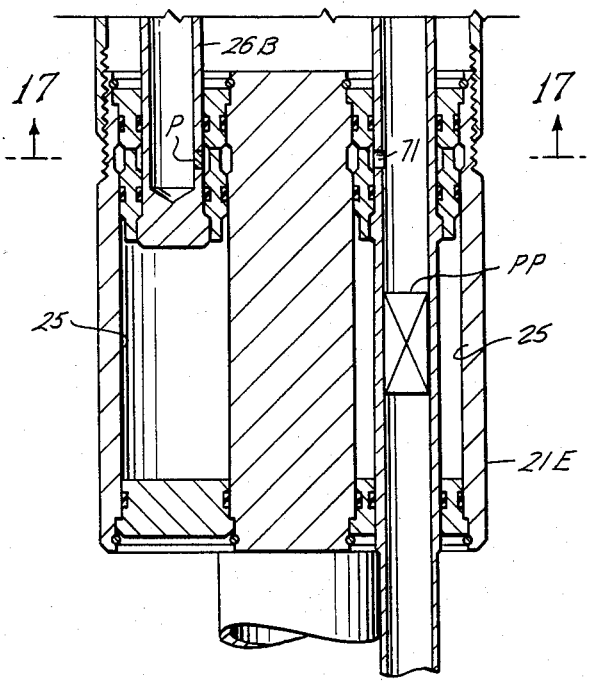
Figure 17:
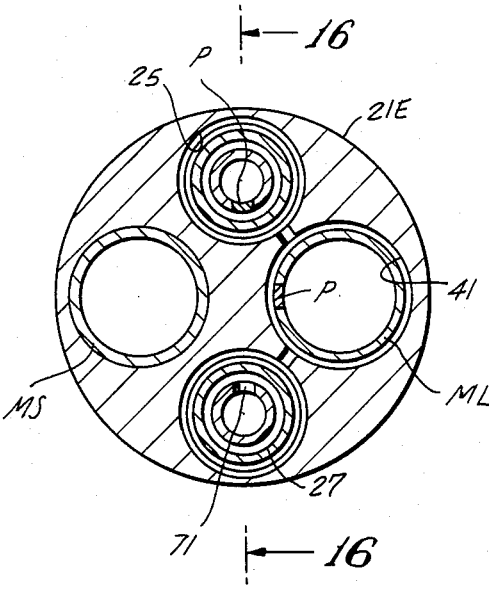

FIGS. 4, 5, 6, 7, 8, 9, 10 and 11 are horizontal cross-sectional views of the packer, as seen along broken lines 4—4, 5—5, 6—6, 7—7, 8—8. 9—9, 10—10 and 11—11, respectively, of FIGS. 1A, 1B and 1C;

FIGS. 12A and 12B are additional vertical sectional views of the upper and lower portions of the packer as seen along broken lines 12—12 of FIG. 8, and upon expansion of the slip assembly and packing element to set the packer at a desired elevation within the well bore;

FIGS. 13A and 13B are further vertical sectional views of the upper and lower portions of the packer, similar to FIGS. 12A, 12B but upon exhaustion of the supply of hydraulic fluid for setting the packer, and lifting of the mandrels to disconnect the upper and lower ends of the tubular rods and raise the upper expander plate to permit the packing element and slip assembly to retract from engagement with the well bore;

FIG. 14 is a partial vertical sectional view of the lower end of the intermediate portion of the packer showing the pistons on the lower ends of the rods and the cylinders in which they are disposed, as seen along broken lines 14—14 of FIG. 15, and wherein ports in both rods are closed and a port in one of the mandrels is opened to permit setting fluid to be supplied to the cylinders through the mandrel;

FIG. 15 is a cross-sectional view of the portion of the packer shown in FIG. 14, as seen along broken lines 15—15 thereof;

FIG. 16 is another vertical sectional view of the packer similar to FIG. 14, but altered to close both ports in the control line rod as well as in the mandrel, and to open a port in the bypass or circulation rod so that fluid may be supplied to the cylinders therethrough; and FIG. 17 is a cross-sectional view of the portion of the packer shown in FIG. 16, as modified, and as seen along broken line 17—17 of FIG. 16.

With reference now to the details of the above-described drawings, the overall packer, which is indicated in its entirety by reference character 20, comprises body means made up of coaxially arranged first and second body sections, and as shown in FIGS. 1A-1C a pair of mandrels ML and MS which extend in side-by-side relation within the body means. As shown in FIG. 1A, mandrel ML is adapted to be connected as a part of tubing string TL (the "long" string) and mandrel MS is adapted to be connected as a part of tubing string TS (the "short" string).

As previously described, the body means is connected to the mandrel ML for lowering therewith into the well bore, and the mandrel MS is free to reciprocate with respect to the body means. Thus, each mandrel carries the weight of the lower portion of the string to which it is connected to permit dual elevators at the wellhead to be so manipulated as to lower the packer to a desired level within the well bore without damage to either string. As also described, since the packer forms part of an annulus safety system (not shown), it is set relatively high in the well bore, although the packer may be used in other environments, as, for example, beneath an uppermost dual packer of more conventional construction and thus deep in the well bore. In this latter event, it performs the more conventional function of separating different production zones.

As will be understood from the description to follow, mandrel MS is also reciprocable with respect to the body means after the packer is set. Also, each mandrel is rotatable with respect to the other as well as with respect to the body means, both before and after setting of the packer. As previously indicated, these manipulations may be useful for reasons known in the art.

Each body section includes parts which are so related to one another as well as with respect to those of the other body section as to permit the packer to be lowered into the well bore and "set" at the desired level and then released and retrieved from the well bore. Thus, as shown in FIGS. 1A, 2A, 3A, 12A and 13A; the first body section includes an upper slip expander part or head 21A, an intermediate slip expander part or retainer ring 21B, and a lower slip expander part or head 21C. As as will be described in detail to follow, a packing element 22 is supported by the expander head 21A in position for expansion and contraction into and out of sealing engagement with the well bore, as shown in FIGS. 2A, 3A, 12A and 13A and upper and lower sets of slips 23U and 23L are carried about the upper and lower expander heads 21C and the intermediate retainer ring 21B for expansion and contraction into and out of gripping engagement with the well bore.

As shown in FIG. 1A, the mandrel ML and MS extend through side-by-side holes in the packing element and in the slip expander parts which are large enough to permit free vertical movement between the parts and the mandrels, but which nevertheless permit the packing element to seal about the mandrels when expanded in order to close off the well bore. As also shown, there are four equally spaced-apart groups of slips arranged in pairs on opposite sides of a centerline through the mandrel axes (see FIG. 4), with each group being received within slots in outer conical surfaces of the expander heads, as will be described in detail to follow.

As shown in FIGS. 1A, 1B, 2A, 2B, 3A, 3B, 12A and 13A, a tubular housing 21D is connected to the lower expander head 21C for extension downwardly therefrom to surround the mandrel, and fitting 21E connected to the lower end of the housing 21D has side-by-side holes through which the lower ends of the mandrels extend, as shown in FIGS. 15 and 17 as well as FIG. 1A. As will be described in detail to follow, and as shown in FIGS. 3B, 12B, 13B, 14 and 16, cylinders 25 are formed in the lower fitting 21E intermediate the mandrel holes (see FIGS. 15 and 16) to provide chambers to which fluid may be supplied or from which hydraulic fluid may be exhausted to alternately set or release the packer.

Figure 11:
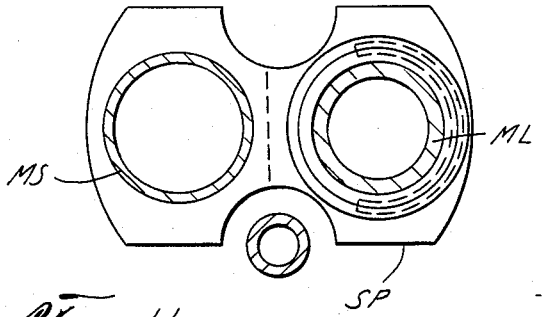

As shown in FIGS. 1C and 11, the lower ends of the mandrels beneath fitting 21E are held in spaced relation by a plate SP having holes which closely receive each and releasably latched to the lower end of mandrel ML. In addition to spacing the mandrel, plate SP will, upon engagement with the lower end of fitting 21E, limit upward movement of mandrel ML with respect to the body.

Figure 2A:
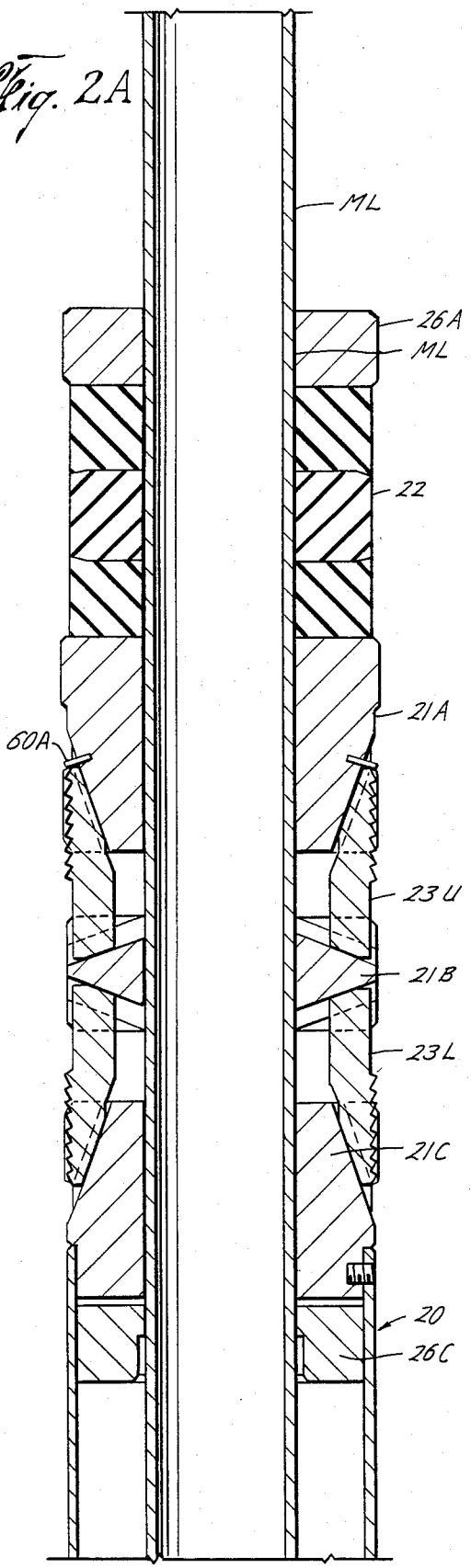
FIGS. 2A and 2B are also vertical sectional views of the upper and intermediate portions of the packer of FIGS. 1A and 1B, but as seen along broken lines 2—2 of FIG. 7.
Figure 2B:
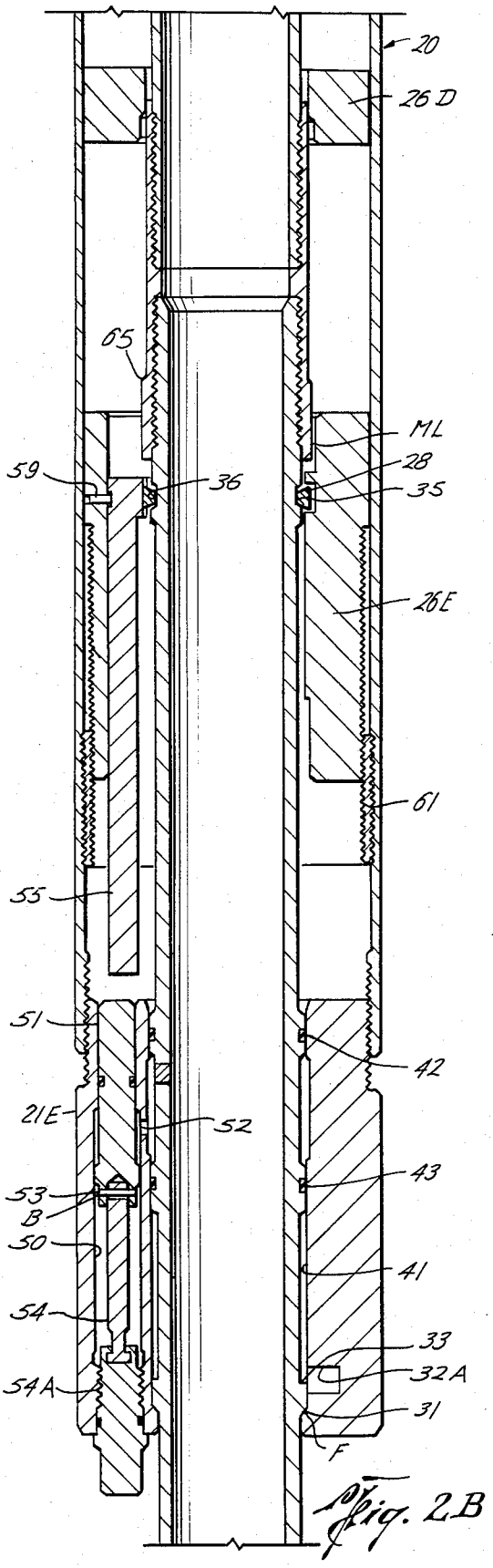

As shown in FIGS. 1B, 2B and 12B, an internal shoulder 30 about the lower end of fitting 21E is engageable with a shoulder 31 about mandrel ML so that, prior to and during setting of the packer, as will be described, the fitting including cylinders 25 is held against upward movement with respect to the mandrel. Also, a shearable plate 32 (see FIGS. 10, 12B and 13B) is carried within a slot 32A (see FIG. 10) in the side of the fitting so as to engage a shoulder 33 (see FIGS. 1B and 2B) about the mandrel above shoulder 31 and thus prevent its upward movement with respect to the fitting until a sufficiently strong upward pull is applied to the mandrel in order to shear the plate to permit release of the packer, as will also be described to follow.

The second body section includes an upper expander plate 26A above the packing element, and thus on the side of the packing element opposite expander head 21A, and a pair of tubular rods 26B (see FIG. 3B) which are connected at their upper ends to the expander plate and extend downwardly therefrom in side-by-side relation. More particularly, as shown in FIGS. 4 to 8, the rods are disposed generally diametrically opposite one another intermediate mandrels ML and MS and extend through side-by-side holes in the packing element and slip expander parts (FIGS. 3A, 4 and 5) for free relative movement with respect thereto.

Figure 3A:
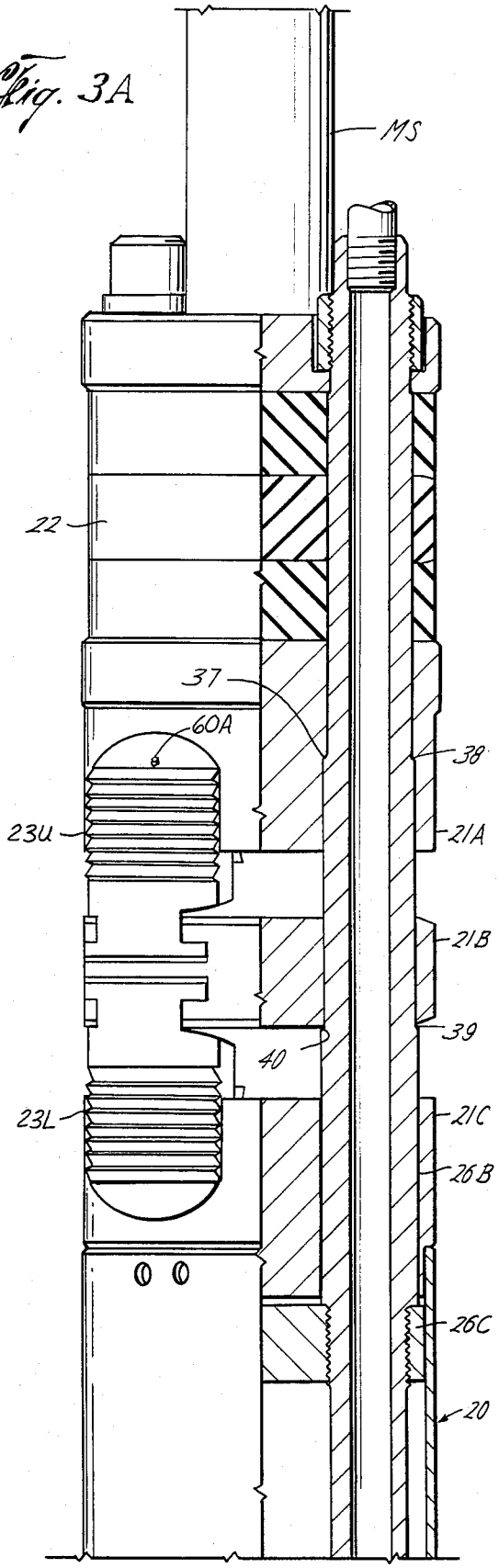
FIGS. 3A and 3B are additional vertical sectional views of the packer of FIGS. 1A and 1B, with the right-hand side thereof shown in vertical section and the left-hand side thereof being shown in elevation, as seen along broken lines 3—3 of FIG. 8.

The second body section also includes a spacer plate 26C which, as shown in FIGS. 1A, 2A, 3A, 12A, and 13A, is received closely within housing 21D of the first body section and, as shown in FIGS. 3A and 12A, has holes therethrough threadedly connected to the rods 26B just beneath the lower expander head 21C of the first body section. Additional holes therein receive the mandrels therethrough (see FIGS. 1A and 2A) while holding them in properly spaced relation. As will be described to follow, plate 26C is adapted to be engaged by mandrel ML, as shown in FIG. 13A, so as to lift the tubular rods and thus the expander plate to retract the slip assembly and permit the packing element to retract in order to release the packer.

Figure 6:
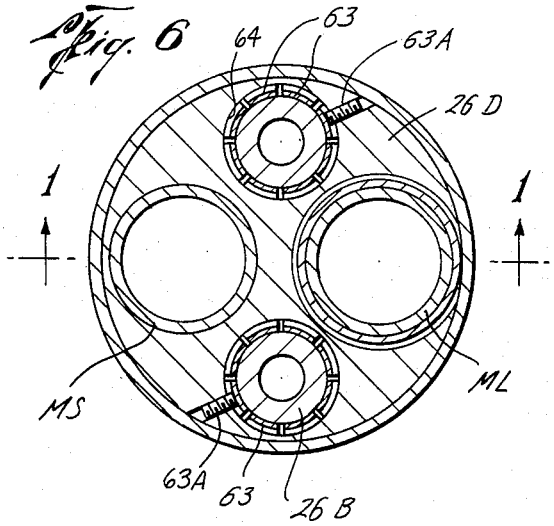

Another plate 26D beneath the plate 26C, which is also received closely in the housing and has holes which receive the rods as well as the mandrels, as shown in FIG. 6 as well as in FIGS. 1A, 2A and 3A, is releasably connected to the rods by shear pins 63A (see FIG. 6). As will also be described to follow, plate 26D holds in place a means which connects the upper ends of the rods to a fitting 26E connected to lower ends of the rods (FIGS. 3B, 12B and 13B), until engaged by mandrel ML (See FIG. 13A) to lift it out of holding position and thus disconnect the upper and lower ends of the rods as the packer is being released.

Figure 3B:
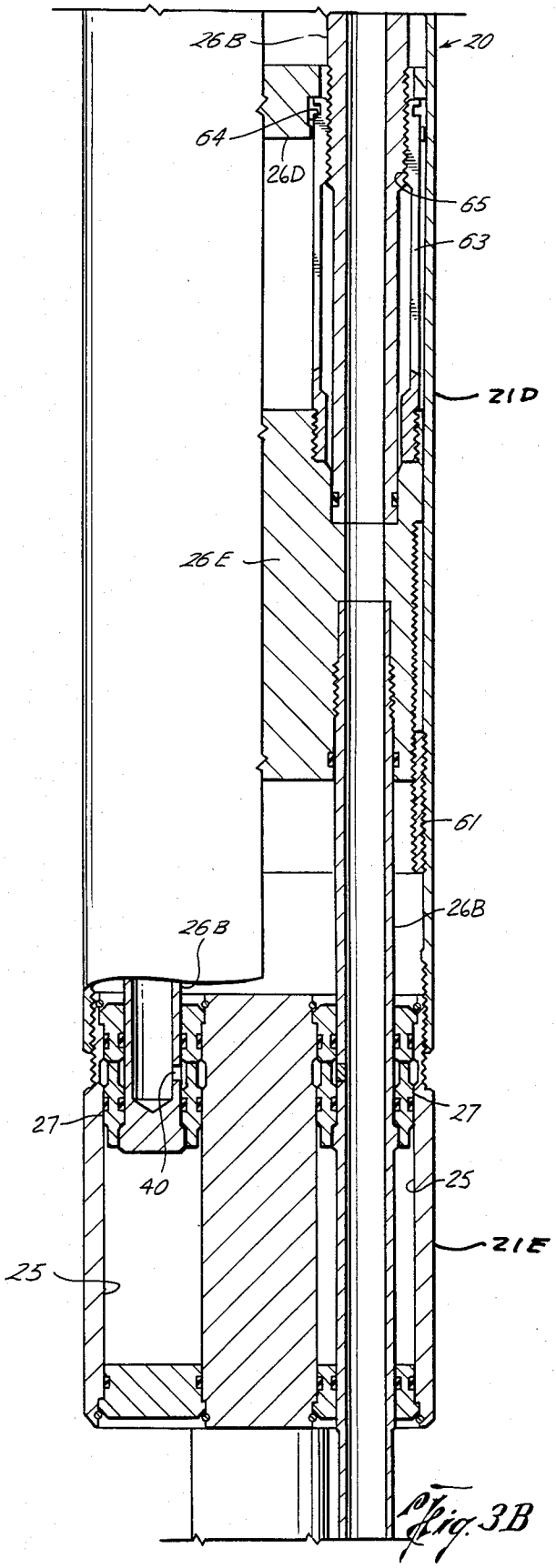

As shown in FIGS. 3B, 12B and 13B, a fitting 26E is connected to the lower ends of the rods 26B beneath plate 26D and is received closely within housing 21D just above fitting 21E. As will be described to follow, this fitting 26E is releasably latched to mandrel ML so as to hold the rods and mandrel against vertical movement, and thus the expander plate 26A in its upper position as the packer is lowered into the well bore. As shown in FIG. 3B, 14 and 16 the rods 26B extend through the fitting 26E and into the cylinders 25 of the fitting 21E, and pistons 27 are carried thereby for sealably sliding within the cylinders during setting and release of the packer, as will be described. The lower end of the leftmost rod shown in FIG. 3B, 14 and 16 is closed, while the lower end of the rightmost rod is open and extends downwardly through the lower end of the rightmost cylinder 25, both for purposes previously mentioned and to be described in detail to follow.

As shown in FIGS. 1A, 1B and 1C, as well as in FIGS. 2A and 2B, and 3A and 3B, 12A and 12B, and 13A and 13B, during lowering of the packer into the well bore, the expander parts of the first body section are so spaced from one another as to hold the upper and lower sets of slips 23U and 23L in retracted position, and expander plate 26A is so spaced above expander head 21A as to permit the packing element to assume its normally unstressed, retracted position. When so retracted, the outer circumferences of the packing element and slips are generally vertically aligned with the outer walls of the various parts of the packer body so as to move freely within the well bore as the packer is lowered therein. As described below, these various parts of the packer are held in these positions with respect to one another as well as with respect to mandrel ML so as to prevent its accidental setting until it reaches the desired level in the well bore. When the packer is so disposed, hydraulic fluid is supplied to the cylinders 25 above the pistons 27 in order to lower the tubular rods, and thus the expander plate 26A, with respect to the expander heads 21A and 21C of the first body section, and further move the expander parts toward one another, in order to expand both the packing element and the upper and lower set of slips into engagement with the well bore WB, as shown in FIG. 12A.

Figure 7:
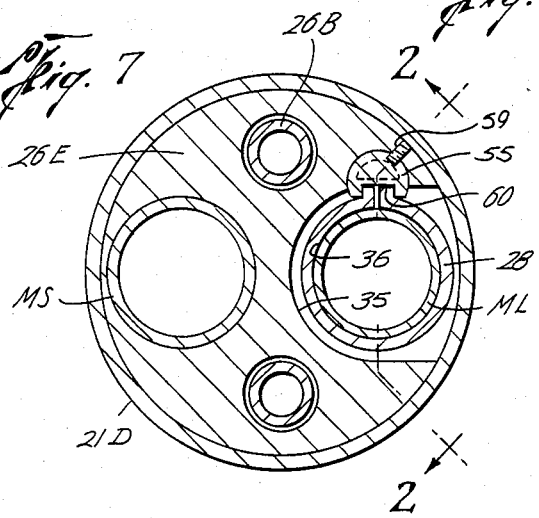

As previously described, fitting 21E, housing 21D, and lower expander head 21C of the first body section are prevented from moving upwardly with respect to mandrel ML by engagement of shoulder 30 on the fitting with shoulder 31 about the mandrel. At the same time, these same parts of the first body section are supported against downward movement with respect to the mandrel by the engagement of shear plate 32 with shoulder 33 about the mandrel. In addition, and as shown in FIGS. 1A, 2A and 7 a latching ring 28 is releasably disposed in oppositely facing grooves 35 and 36 in the hole in fitting 26E through which mandrel ML is received and the outer diameter of the mandrel ML, respectively. Consequently, fitting 26E, and thus the tubular rods 26B as well as the upper expander plate 26A are prevented from moving vertically with respect to the mandrel ML, whereby the upper expander plate 26A is held in its uppermost position with respect to upper expander head 21A, and the pistons 27 are held in their uppermost positions with respect to the cylinders 25 of the first body section fitting 21E.

At the same time, a shoulder 37 FIGS. 3A and 13A about one of the tubular rods is engageable with a shoulder 38 about the hole in upper expander head 21A through which the rod extends so as to hold the expander head in its upper position with respect to the expander ring 21C of the first body section. Additionally, a shoulder 39 (FIGS. 3A and 13A) about the same rod is engageable with a shoulder 40 about the intermediate retainer ring 21B of the first body section so as to hold it in an elevated position with respect to the lower expander head 21C. Thus, with the inner surfaces of the slips of both sets of slips slidably connected by means of dovetail slots to the expander surfaces on the outer sides of the expander heads, as will be apparent from FIG. 4, and the adjacent ends of the slips of both sets slidably connected by T-heads and slots to the retainer ring 21B, both sets of slips will be held by the expander heads and expander ring in the retracted position shown in FIGS. 2A–2B and 3A–3B.

The latching ring 28 is adapted to be moved to a position to release the fitting 26E, and thus permit the rods 26B and expander plate 26A to move downwardly, automatically in response to the supply of hydraulic fluid to the cylinders 25 above the pistons 27 carried by the rods. As will be described to follow, this hydraulic fluid may be supplied to the cylinders in any one of several ways. However, in accordance with the present invention, it may be supplied thereto through one of the tubular rods 26, and, more particularly, the leftmost rod as shown at the lower end of FIG. 3B. The hydraulic fluid may be supplied to the tubular rod through a tubular member (not shown) connected to its upper end and extending vertically thereabove to a source of such fluid at the wellhead. When the packer forms part of an annulus safety system, as is contemplated in the preferred and illustrated embodiment, this tubular member may be connected to such source through conduits of the system located above the packer.

Figure 9:
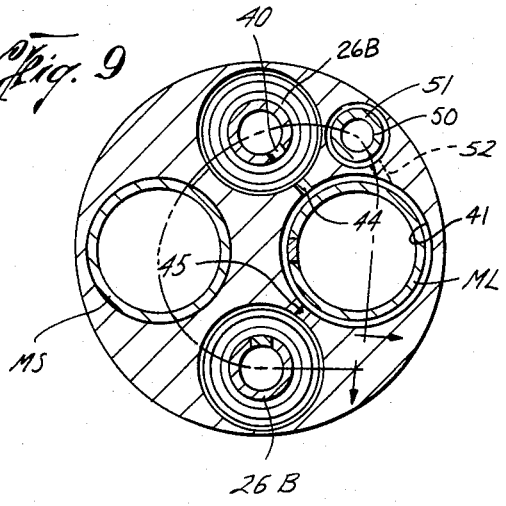

In any event, and as shown in FIG. 3B, as well as in FIG. 9, the lower end of this tubular rod is ported at 40 to connect its bore with the lefthand cylinder above piston 27 on the rod. As shown in FIG. 9, the left-hand cylinder is in turn connected to the other cylinder 25 above the other piston carried by the other tubular rod through ports 44 and 45 in fitting 21E connecting with an annular passageway between mandrel ML and the hole 41 in the fitting through which the mandrel extends, whereby hydraulic fluid supplied through the rod urges both pistons and both rods downwardly. Thus, as shown in FIGS. 1B and 2B, the mandrel ML has enlarged diameter portions which carry seal rings 42 and 43 for slidably sealing within the hole 41 in the fitting 21E above and below the ports.

As shown in FIG. 2B, 12B and 13B, another cylinder 50 is formed in the fitting 21E generally intermediate one of the cylinders 25 and the hole through which mandrel ML extends (see FIG. 9). A piston 51 is sealably slidable in this cylinder (FIGS. 12B and 13B) and urged in an upward direction by hydraulic fluid which is admitted to the cylinder beneath the piston by means of a port 52 (FIGS. 2B, 12B and 13B) connecting with the annulus in the fitting about the mandrel ML, and thus, as best shown in FIG. 9, with the left-hand cylinder 25 shown in FIG. 3. Initially, the piston 51 is held in the position shown in FIG. 2B by means of a shear pin 53 (FIG. 2B) carried on the upper end of a rod 54 connected at its lower end to a plug 54A threaded into an opening in the fitting at the lower end of cylinder 50. When hydraulic pressure is supplied through the tubular rod into the cylinders 25, it will provide sufficient force to shear the pin 53, and thus release the piston 51 to move upwardly into engagement with the lower end of a rod 55 (FIGS. 7, 2B, 12B and 13B) vertically slidable within fitting 26E and having means at its upper end which, in the position shown in FIGS. 2B and 7, retains latch 28 in its latching position.

As shown, in FIGS. 7 and 2B the rod 55 is held with its upper retainer head opposite latch ring 28, by means of a shear pin 59 carried by the fitting 26E. As shown in FIG. 7, the head of the retainer part has a slot 60 formed therein which receives the free ends of the retainer ring 28 to hold them together and thus hold the retainer ring in its smallest circumferential shape, in which shape the retainer ring bridges the gap between the grooves 35 and 36 in the mandrel ML and fitting 26E so as to prevent downward movement of the fitting with respect to the mandrel, and thus with respect to the cylinder fitting 21E. However, when the retainer part and its head are moved upwardly by means of the piston 51 as shown in FIG. 13, the slot 60 slides above the free ends of the retainer ring so as to permit the retainer ring to expand circumferentially toward its unstressed position, and thus move outwardly into groove 35 in the fitting and out of the groove 36 about the mandrel ML. As a result, the rods are free to be moved downwardly by hydraulic fluid within the cylinders 25 above the pistons 27 and thus the tubular rods downwardly. To facilitate this downward movement with a minimum of force, the cylinders beneath the pistons are precharged with gas at atmospheric pressure or at least some pressure considerably below that of the well bore.

As previously noted, the latching ring 28 is thus moved to releasing position with a minimum force, and thus in response to relatively low hydraulic pressure, due to the fact that the force required to shear the pin 53 and thus release the piston 51 is independent of the force required to engage and lift the rod 55. In addition, the spacing of the upper end of piston 51 below the lower end of rod 55 permits the piston to be accelerated upwardly and thus apply an upward jar to the rod, which is helpful in shearing the pin 59 and continuing to move the rod upwardly to a position in which it releases the latching ring 28.

As the rods 26B pull the retainer plate 26A downwardly so as to compress the packing element 22 to some extent, the packing element transmits a downward force to the upper expander ring 21A to cause it to begin to move downwardly. This in turn, lowers the upper set of slips 23U to cause the retainer ring 21B to move downwardly, which will in turn exert a downward force on the lower set of slips 23L to cause them to move downwardly with respect to lower expander head 21C. As shown in FIGS. 2A and 3A, shear pins 60 are mounted on the upper retainer head 21A adjacent the upper ends of the slips of the upper set 23U, so that this movement of the upper expander head 21A downwardly with respect to the lower expander ring 21C will cause the slips of the lower set to slide downwardly over the lower expander head 21C and into engagement with the well bore prior to the expansion of the slips of the upper set 23C. However, when the lower set of slips have moved outwardly into engagement with the well bore, continued downward movement of the upper expander plate 26A will cause the pins 60 to shear, and thus move the upper set of slips outwardly into gripping engagement with the pipe. With both sets of slips engaging the pipe, continued downward movement of the expander plate 26A will expand the packing element into sealing engagement with the well bore, as shown in FIG. 12A.

The packer is locked in its set position by means of a body lock ring 61 which, as shown in FIGS. 1B, 2B and 3B, as well as in FIG. 8, is disposed in an annular space between the outer diameter of fitting 26E and the inner diameter of housing 21D. Thus, as well known in the art, the body lock ring comprises a split ring having ratchet teeth on its inner diameter engageable with ratchet teeth about the outer diameter of the fitting 26E, and cam teeth on its outer diameter engageable with cam teeth on the inner diameter of the housing. The ratchet teeth are so arranged as to permit the fitting to be moved downwardly over the ratchet teeth of the lock ring, as the lock ring moves radially inwardly and outwardly with respect to the cam teeth on the housing 21D. However, when the fitting has been so lowered, it is held against return upward movement by the ratchet teeth, and thus locked in its lower, setting position.

As will be seen from FIG. 12A, due to the continued downward movement of the rods and expander plate upon setting of the slips, with the packer so set, shoulder 37 about one of the tubular rods is lowered beneath the shoulder 38 within the hole of the upper expander head 21A in which it is received. Shoulder 39, on the other hand, has moved into the enlarged hole in the lower expander head 21C in which the rod is received.

As shown in FIGS. 3B, 12B and 13B, the upper and lower ends of the tubular rods intermediate the expander plate and fitting 21E are connected to one another prior to and during setting of the packer by collet fingers 63 (FIG. 6) which are connected to the fitting 26E and extend upwardly about the rods within the space between the fitting and plate 26D. The upper ends of the collet fingers fit within a counterbore 64 in the plate 26D and releasably connect to the outer diameter of the rod which extends through holes in the plate by means of teeth 65. The previously described shear pins 63A (FIG. 6) releasably connects plate 26D to the upper ends of the collet fingers.

When it is desired to release the packer, hydraulic pressure in the cylinders 25 is exhausted, and an upward pull is applied to mandrel ML to shear plate 32 (FIG. 1C), and thus permit both mandrels to be raised. A shoulder 65 about the mandrel ML (FIGS. 1A and 2B) will then move upwardly to engage the lower side of plate 26D (see FIG. 13A), and upon continued upward movement, shear pin 63A and lift the plate 26D and thus raise counterbore 64 above the upper ends of collet fingers 63. The collet fingers are then free to move outwardly to their unstressed positions, as shown in FIG. 13, and thus disconnect the upper and lower ends of the tubular rods.

This disconnection of the upper and lower ends of the rods will permit their lower ends and thus the fitting 26E to move downwardly with respect to the mandrels, as shown in FIG. 13B. Since the fitting 21E remains locked to the fitting 26E, and as also shown in FIG. 13B, it also moves downwardly. As a result, the seal rings 42 and 43 about the mandrels move out of the seal bores in fitting 21E, and seal rings about the lower ends of the upper ends of the rods move out of seal bores within the fitting 26E. Consequently, the mandrels may be raised to lift the expander plate and the slip expander parts out of expanding positions within the slips without having to overcome the frictional resistance of these sliding seals.

As will be understood from FIG. 12B, release of the lower ends of the rods from the fitting 26E will permit the fitting to be urged downwardly by the force of hydrostatic pressure which is resisted only by atmospheric pressure in the cylinders 25 beneath the pistons 27. This not only holds the lower ends of the rods down, but also forces the fitting downwardly with sufficient force to jar against the upper end of the fitting 21E so as to assist it in moving downwardly in the event it is otherwise stuck. Upon continued upward movement of the mandrels, a shoulder 70 about the mandrel ML will engage the spacer plate 26C, as shown in FIG. 13A, and thus lift the plate and the tubular rods 26B, and consequently the expander plate 26A, a further upward distance sufficient to permit the packing element to fully retract to the position shown in FIG. 13A.

As previously described, the primary purpose for the through bore of the tubular rod shown on the right-hand side of FIG. 3B is to permit the circulation of fluid between the annulus above and below the packer. For this purpose, in a annulus safety system of the type described, the upper end of this rod is connected with another tubular member leading to a conduit in the system which has a valve therein to provide fail-safe control over the passage of the circulation of fluid between the annulus above and below the packer. This other tubular rod is also useful in providing an alternative way of supplying hydraulic fluid to or exhausting hydraulic fluid from the cylinders 25 above the pistons 27. Thus, as shown in FIGS. 16 and 17, this rod may be provided with a port 71 therethrough connecting with the right-hand cylinder above the piston 27 therein, so that with a plug P disposed within the port 40 in the other tubular rod, and a plug PP removably landed within the right-hand tubular rod, as shown in FIG. 16, hydraulic fluid may be supplied to or exhausted from the right-hand cylinder, and thus the left-hand cylinder 25 as well as the auxiliary cylinder 50 through the right-hand tubular rod.

As also previously described, and as illustrated in FIG. 15, in accordance with another alternative, hydraulic fluid may instead be supplied or exhausted through the mandrel ML. For this purpose, a port 72 in the mandrel connects with the annular passageway intermediate the seal rings 42 and 43. Thus with this port open and with the ports 40 and 71 closed, as shown in FIGS. 14 and 15, hydraulic fluid may be so supplied or exhausted through the mandrel. Of course, when hydraulic fluid is so alternatively supplied or exhausted through one of the tubular rods, a plug PP fills the port 72, as shown in FIG. 17.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A multiple well string packer, comprising body means disposable within a well bore, a packing element supported by the body means, a slip assembly carried about the body means, a pair of mandrels each adapted to be connected in a well string and extending vertically within the body means closely through side-by-side holes within the packing element, means for supporting said body means from one of the mandrels to permit the body means to be lowered therewith into the well bore, said body means including fluid-actuated means for causing the slip assembly to be moved into gripping engagement with the well bore and the packing element to be moved into sealing engagement with the well bore, when said packer has been lowered with said strings into a desired position within the well bore, and the other mandrel being movable vertically with respect to the body means to permit relative vertical movement between said strings during lowering of said packer into the well bore.

2. A packer of the character defined in claim 1, wherein each mandrel is rotatable with respect to the body means and one another.

3. A packer of the character defined in claim 1, wherein the other mandrel is also movable vertically with respect to said body means when said slip assembly and packing element have been moved into engagement with the well bore.

4. A multiple string packer, comprising body means disposable within a well bore and including first and second body sections which are vertically reciprocable with respect to one another, a packing element supported by the first body section, a slip assembly carried about the first body section, a pair of mandrels each adapted to be connected in a well string and extending vertically within the body sections and closely through side-by-side holes within the packing element, cylinder means formed in one of said body sections, the other body section having means including piston means vertically reciprocable within the cylinder means for expanding said packing element into sealing engagement with said well bore and said slip assembly into gripping engagement therewith in response to the supply of fluid pressure to said cylinder means, and means for supporting said body means from one of the mandrels to permit the body means to be lowered therewith into the well bore, the other mandrel being movable vertically with respect to the body means to permit relative vertical movement between said strings during lowering of said packer into the well bore.

5. A packer of the character defined in claim 4, wherein each mandrel is rotatable with respect to the body means and one another.

6. As in 4, wherein the other mandrel is also movable vertically with respect to said body means when said slip assembly and packing element have been moved into engagement with the well bore.

7. A multiple well string packer, comprising body means disposable within a well bore, a packing element supported by the body means, a slip assembly carried about the body means, a pair of mandrels each adapted to be connected in a well string and extending vertically within the body means and closely through side-by-side holes within the packing element, a tube having an open upper end adapted to be connected to a tubular member and extending closely through another hole in the packing element intermediate the holes through which the mandrels extend, means for supporting said body means from one of the mandrels to permit the body means to be lowered therewith into the well bore, said body means including fluid-actuated means for causing the slip assembly to expand into gripping engagement with the well bore and the packing element to be expanded into sealing engagement with the well bore, when the packer has been lowered into a desired position within the well bore, and said tube also being open at its lower end to permit circulation between the annulus below the packer and the tubular member to which the one tube is connected when said slip assembly and packing element have been moved into engagement with the well bore.

8. A packer of the character defined in claim 7, including another tube having an upper end adapted to be connected to another tubular member and extending closely through a further hole in the packing element intermediate the holes through which the mandrels extend and generally diametrically opposite the additional hole through which the firstmentioned tubular member extends, the lower end of said other tube connecting with the fluid-actuated means to permit the supply of fluid thereto through the other tubular member to which the other tube is connected.

9. A packer of the character defined in claim 8, wherein the body means includes first and second body sections adapted to be moved vertically with respect to one another, the packing element is supported on the first section and the slip assembly means is carried thereabout, the second body section includes an expander plate on the side of the packing element opposite that supported by the first body section, the first body section has a pair of cylinders formed therein, each tube has a piston reciprocable within a cylinder and connected to the expander plate, and means is provided for supplying fluid pressure to each said cylinder in order to move said expander plate relatively to the first body section in order to expand the packing element and slip assembly into engagement with the well bore.

10. A well multiple string packer, comprising body means disposable within a well bore and including first and second body sections which are vertically reciprocable with respect to one another, a packing element supported by the first body section, a slip assembly including slips for resisting upward and downward movement when in gripping engagement with the pipe and carried about expander surfaces on the first body section beneath the packing element, a pair of mandrels each adapted to be connected in a well string and extending vertically within the body sections and closely through side-by-side holes within the packing element, means for supporting said body means from one of the mandrels to permit the body means to be lowered therewith into the well bore, said second body section including an expander plate above the packing element, and a pair of rods depending from the plate and extending closely through holes in the packing element intermediate the mandrels, said first section having a pair of cylinders formed therein and each rod having a piston vertically reciprocable within a cylinder, in response to the supply of fluid pressure to said cylinders, in order to lower the expander plate to expand the packing element into engagement with the well bore and cause the slips to move over said expander surfaces into gripping engagement with the well bore, and means on the first and second body sections for locking said expander plate in its lower position automatically in response to lowering of said piston means.

11. A packer of the character defined in claim 10, wherein said second body section includes a part connected to both rods and coaxially arranged with respect to the first body section, and said locking means includes a locking ring disposed between said part and the first body section.

12. A packer of the character defined in claim 10, including means connecting the upper and lower ends of each rod intermediate the expander plate and pistons, and means for releasing the connection upon exhaustion of the fluid in the cylinder means and lifting of the mandrels to retrieve the packer from the well bore.

13. A packer of the character defined in claim 10, wherein one of the rods is a tube which is open at both ends to permit circulation between the annulus below the packer and a tubular member to which the upper end of the one tube is connected.

14. A packer of the character defined in claim 13, wherein the other mandrel is movable vertically with respect to the body means to permit relative vertical movement between said strings during lowering of said packer into the well bore.

15. A packer of the character defined in claim 13, wherein the other rod is a tube whose lower end connects with the cylinder in which its piston is disposed to permit the supply of fluid thereto through a tubular member to which the upper open end of the tube is connected.

16. A packer of the character defined in claim 10, wherein one of the rods is a tube whose lower end connects with the cylinder in which its piston is disposed to permit the supply of fluid thereto through a tubular member to which the upper open end of the tube is connected.

17. A multiple well string packer, comprising body means disposable within a well bore and including first and second body sections which are vertically reciprocable with respect to one another, a packing element supported by the first body section, a slip assembly including first and second sets of slips for upward and downward movement when in gripping engagement with the pipe and carried about first and second expander parts of the first body section, respectively, which are beneath the packing element vertically reciprocable with respect to one another, a pair of mandrels each adapted to be connected in a well string and extending vertically within the well bore and closely through side-by-side holes within the packing element, said second body section including an expander plate above the packing element and a pair of rods extending closely through holes in the packing element intermediate the mandrels, the second part of the first section having a pair of cylinders formed therein and each rod having a piston thereon vertically reciprocable within a cylinder, in response to the supply of fluid pressure to said cylinder, in order to lower the expander plate with the rods to expand the packing element into engagement with the well bore and cause the slips to move over said expander surfaces into gripping engagement with the well bore, means connecting the second body section to one of the mandrels for lowering therewith, means supporting the first part of the first body section from the second body section in order to maintain the slips and packing element in retracted position until the second body section is released from the one mandrel, means for releasing said connecting means in response to the supply of fluid to said cylinders, means preventing upward movement of the second part of the second body section upon release of said connecting means, means for supporting the second part of the second body section from the one mandrel upon release of said connecting means, and means on the second body section and second part of the first body section for releasably locking the expander plate in its lower position automatically in response to lowering of said piston means.

18. A packer of the character defined in claim 17, wherein the means for supporting the second part of the second body from the one mandrel is releasable to permit said one mandrel to be lifted, and said one mandrel has means thereon for lifting the second body section with it in order to lift the expander plate to permit the packing element and slip assembly to retract.

19. A multiple string packer, comprising body means disposable within a well bore and including first and second body sections which are vertically reciprocable with respect to one another, a packing element supported by the first body section, a slip assembly carried about the first body section, a pair of mandrels each adapted to be connected in a well string and extending vertically within the body section and closely through side-by-side holes within the packing element, said second body section including an expander plate on the side of the slip assembly and packing elements opposite the first body section and a pair of rods extending closely through holes in the packing element intermediate the mandrels, said first body section having a pair of cylinders formed therein and each rod having a piston vertically reciprocable within a cylinder, the cylinders on one side of the pistons containing gas at less than well bore pressure, means for supplying fluid pressure to said cylinders on the other sides of the pistons in order to expand the packing element into engagement with the well bore and cause the slips to expand into gripping engagement with the well bore, said fluid pressure supplying means including means sealing between the mandrels and first body section, means on the first and second body sections for locking said expander plate in locking position automatically in response to lowering of said pistons, and said second body section including a common part carried by the rods, means connecting the rods intermediate the expander plate and common part, and means for releasing said connecting means as the fluid pressure is exhausted and the mandrels are lifted to permit the packing element to retract and to withdraw the slip assembly whereby said sealing means betwewen the mandrels and first body sections are seaprated and the common part is urged toward said first body section due to fluid pressure in the cylinders on the one side of the pistons.

20. A multiple well string packer, comprising body means disposable within a well bore and including first and second body sections which are vertically reciprocable with respect to one another, a packing element supported by the first body section, a slip assembly carried about the first body section, a pair of mandrels each adapted to be connected in a well string and extending vertically within the body sections and closely through side-by-side holes within the packing element, said second body section including an expander plate on the side of the packing element and slip assembly opposite the first body section and a pair of rods extending from the plate closely through a hole in the packing element intermediate the mandrels, said first section having a pair of cylinders formed therein and each rod having a piston vertically reciprocable within a cylinder in response to the supply of fluid pressure to said cylinders, means connecting the second body section to one of the mandrels to hold the expander plate in non-expanding position, means for releasing said connecting means in response to the supply of fluid to said cylinders, means for holding the first body section against vertical movement with respect to the second body section, so that, upon release of said connecting means, the expander plate moved with the rods relatively to the first body section to expand the packing element into engagement with the well bore and cause the slips to move over said expander surfaces into gripping engagement with the well bore.

21. A well packer, comprising body means disposable within a well bore and including first and second body sections which are vertically reciprocable with respect to one another, a packing element supported by the first body section, a slip assembly carried about the first body section, a mandrel adapted to be connected in a well string and extending vertically within the body sections and closely through a hole within the packing element, said body sections having means for expanding the packing element into sealing engagement with the well bore and the seal assembly into gripping engagement therewith upon relative vertical movement between said sections, fluid-actuated means including a cylinder formed in one section and a piston on the other section reciprocable within the cylinder for so moving the body sections, means for releasably holding the body sections in non-expanding positions, including latch means movable between a position connecting the other section to one of the mandrels for vertical movement therewith and another position releasing said section for relative vertical movement with respect to said one mandrel, and means for moving the latch means from connecting to releasing position, comprising additonal fluid-actuated means including a cylinder formed in said one section and a piston reciprocable in said additional cylinder, and means initially holding said additional piston in a position spaced from the latch means but shearable upon the supply of fluid to said additional cylinder to enable said additional piston to engage and move said latch means to releasing position.

22. A packer of the character defined in claim 21, wherein the latch means comprises a split ring disposable within opposed grooves in the other body section and mandrel, and a part movable by said additional piston between a position retaining the ring within said grooves and another position releasing it for movement out of one groove.

23. A multiple well string packer, comprising body means including first and second relatively movable body sections disposable within a well bore, a packing element supported by the first body section, a slip assembly carried about the first body section, a pair of mandrels each adapted to be connected in a well string and extending vertically within the body means and closely through side-by-side holes within the packing element, a pair of tubes having open upper ends adapted to be connected to tubular members and extending closely through additional side-by-side holes in the packing element intermediate the holes through which the mandrels extend, said first body section having cylinders formed therein, said second body section having an expander plate on the side of the packing element and slip assembly opposite the pistons reciprocable in the cylinders and connected to the plates by said tubes.

one of said tubes being open at its lower end to permit circulation between the annulus below the packer and the tubular member to which the one tube is connected, and the other tube having a lower end connecting with the cylinders to permit the supply of fluid thereto through the other tubular member to which the other tube is connected, whereby the expander plate and first body section are caused to move relatively to one another in order to expand the packing element and slip assembly into engagement with the well bore.

24. A packer of the character defined in claim 23, wherein means are also provided for selectively supplying fluid to said cylinders through one of the mandrels and the well string to which it is connected.

25. A packer of the character defined in claim 24, wherein means are also provided for selectively supplying fluid to said cylinders through said one tube and the tubular member to which it is connected.

26. A piston of the character defined in claim 23, wherein means are also provided for selectively supplying fluid to said cylinders through said one tube and the tubular member to which it is connected.

* * * * *